US011312521B2

(12) United States Patent
Takemoto

(10) Patent No.: US 11,312,521 B2
(45) Date of Patent: Apr. 26, 2022

(54) CONTAINER PACKAGING APPARATUS

(71) Applicant: SHIBUYA PACKAGING SYSTEM CORPORATION, Ishikawa (JP)

(72) Inventor: Tomohiro Takemoto, Ishikawa (JP)

(73) Assignee: SHIBUYA PACKAGING SYSTEM CORPORATION, Ishikawa (JP)

( * ) Notice: Subject to any disclaimer, the term of this patent is extended or adjusted under 35 U.S.C. 154(b) by 217 days.

(21) Appl. No.: 16/726,363

(22) Filed: Dec. 24, 2019

(65) Prior Publication Data

US 2020/0207493 A1 Jul. 2, 2020

(30) Foreign Application Priority Data

Dec. 28, 2018 (JP) ..... JP2018-247151

(51) Int. Cl.

| | |
|---|---|
| ***B65B 5/10*** | (2006.01) |
| ***B65B 43/42*** | (2006.01) |
| ***B65B 55/24*** | (2006.01) |
| ***B65B 7/28*** | (2006.01) |

(52) U.S. Cl.

CPC ..... *B65B 55/24* (2013.01); *B65B 5/10* (2013.01); *B65B 7/28* (2013.01); *B65B 43/42* (2013.01)

(58) Field of Classification Search

CPC ..... B65B 5/10; B65B 7/28; B65B 7/2878; B65B 43/42; B65B 43/58; B65B 43/59; B65B 31/025; B65B 31/028; B65B 31/041; B65B 31/043; B65B 55/10; B65B 55/24; B05B 13/0663

See application file for complete search history.

(56) References Cited

U.S. PATENT DOCUMENTS 3,140,571 A * 7/1964 Rauh ..... B29C 66/83221 53/477
4,262,708 A * 4/1981 de Echeandia ..... B65B 55/24 141/7
4,312,171 A * 1/1982 Vadas ..... B65B 31/041 53/512

(Continued)

FOREIGN PATENT DOCUMENTS

DE 2850384 A1 * 5/1980 ..... B29C 66/8432
EP 0300920 A1 * 7/1987 ..... A47L 15/22

(Continued)

*Primary Examiner* — Joshua G Kotis
(74) *Attorney, Agent, or Firm* — Greenblum & Bernstein, P.L.C.

(57) ABSTRACT

A container packaging apparatus includes a retainer for retaining the container; a container supplier for supplying a container to the retainer; a filler for filling contents into the container; and a cleaner for removing deposits on a flange portion of the container filled with the contents from the filler. The cleaner includes a covering member for covering an outer periphery of the flange portion of the container; a lifting device for relatively moving the covering member up and down with respect to the container so that the covering member covers the outer periphery of the flange portion of the container; an ejector for ejecting gas toward the flange portion of the container to blow off deposited matter; and a suction device for removing the deposited matter from inside the covering member after being blown off by the ejector.

6 Claims, 3 Drawing Sheets

(56) References Cited

U.S. PATENT DOCUMENTS

| | | | | | |
|---|---|---|---|---|---|
| 4,409,775 | A * | 10/1983 | Brody | A23B 7/10 | 134/152 |
| 4,511,426 | A * | 4/1985 | Linner | B29B 13/025 | 156/497 |
| 4,771,903 | A * | 9/1988 | Levene | B65B 7/2878 | 156/69 |
| 4,791,775 | A * | 12/1988 | Raque | B65B 31/043 | 53/110 |
| 4,957,581 | A * | 9/1990 | Jahrig | B29C 66/1122 | 156/499 |
| 5,195,294 | A * | 3/1993 | Baranowski | B65B 55/02 | 156/281 |
| 6,691,747 | B1 * | 2/2004 | Marcus | B65B 31/041 | 141/54 |
| 7,357,159 | B2 * | 4/2008 | Popplau | B65B 31/025 | 141/11 |
| 8,591,826 | B2 * | 11/2013 | Auer | B65B 55/10 | 422/300 |
| 9,428,329 | B2 * | 8/2016 | Trombetta | B65B 3/022 | |
| 10,106,282 | B2 * | 10/2018 | Daniel | B65B 3/04 | |
| 2016/0068288 | A1 * | 3/2016 | Palumbo | B29C 66/919 | 53/511 |
| 2016/0288939 | A1 * | 10/2016 | Sawada | B29C 66/0222 | |

FOREIGN PATENT DOCUMENTS

| | | |
|---|---|---|
| JP | 52-139173 | 10/1977 |
| JP | 60-003046 | 1/1985 |

* cited by examiner

CONTAINER PACKAGING APPARATUS

BACKGROUND OF THE INVENTION

1. Field of the Invention

The present invention relates to a container packaging apparatus for filling with contents and packaging a container, and more particularly, to a container packaging apparatus including a means for removing a substance deposited on a flange portion of the container.

2. Description of the Related Art

A container packaging apparatus is known that fills content into a container having a flange portion around the opening and attaches a container lid to the flange portion to seal the container. In such a container packaging apparatus, during the filling operation the contents may be blown upward or splashed and leave deposits on the flange portion of the container. Since deposits on the flange portion may cause a sealing failure of the container lid, there is known a container packaging apparatus that sprays air toward the flange portion to remove deposits from the flange portion (see Japanese Examined Utility Model (Registration) Application Publication No. S60-3046 and Japanese Unexamined Utility Model Application Publication No. S52-139173).

SUMMARY OF THE INVENTION

However, in the configurations adopted in the above-mentioned patent documents, deposits blown off of the flange portion by the injected air may enter the container or attach to other containers or the surroundings. Accordingly, in the conventional configuration, foreign matter may enter the container, and when the content is food, there is a possibility that adherent matter scattered to the periphery may lead to the propagation of bacteria.

One aspect of the present invention is the removal of the matter deposited or adhered to the flange portion without contaminating the inside of the container with the matter or scattering the matter to the periphery.

A container packaging apparatus according to a first aspect of the present invention includes a retainer for retaining the container; a container supplier for supplying a container to the retainer; a filler for filling contents into the container; and a cleaner for removing deposits on a flange portion of the container filled with the contents by the filler. The cleaner includes a covering member for covering the outer periphery of the flange portion of the container; a lifting device for relatively moving the covering member up and down with respect to the container so that the covering covers the outer periphery of the flange portion of the container; an ejector for ejecting gas toward the flange portion of the container to blow off deposited matter; and a suction device for removing the deposited matter from inside the covering member after being blown off by the ejector.

BRIEF DESCRIPTION OF THE DRAWINGS

The objects and advantages of the present invention will be better understood from the following description with references to the accompanying drawings in which.

DESCRIPTION OF THE PREFERRED EMBODIMENTS

Figure 1:
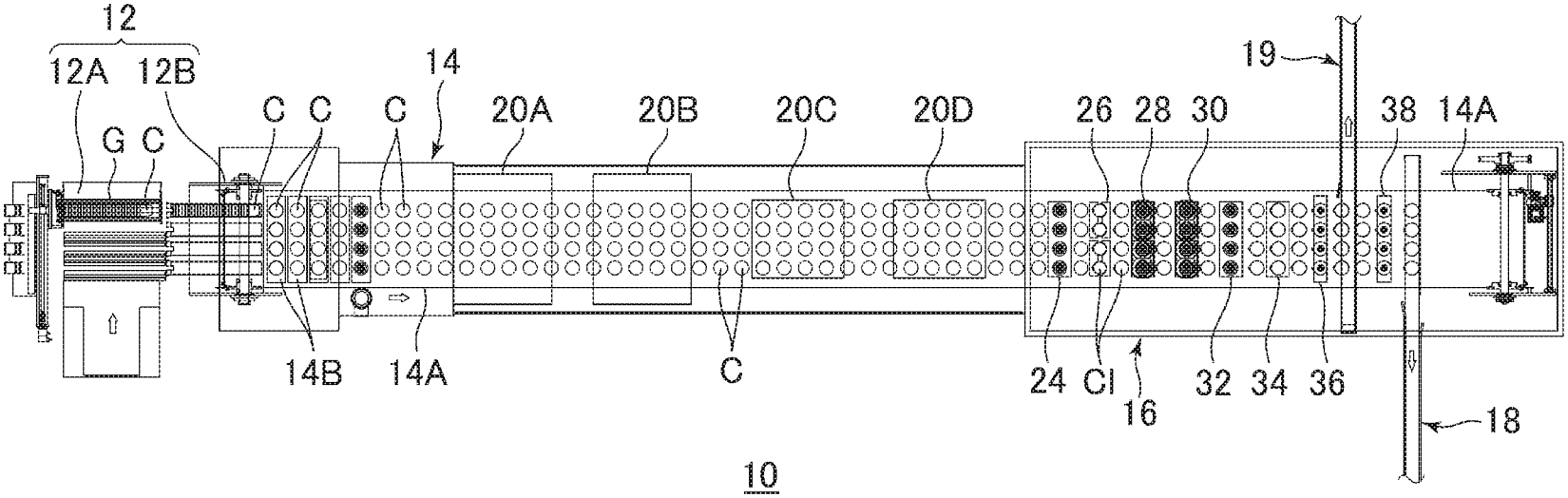
FIG. 1 is a plan view of a container packaging apparatus according to an embodiment of the present invention.

The present invention is described below with references to the embodiments shown in the drawings. FIG. 1 is a plan view of a container packaging apparatus, which is an embodiment of the present invention.

The container packaging apparatus 10 of the present embodiment is, for example, an apparatus that supplies a plurality of types of foodstuffs (ingredients) into a cup-shaped container C having an opening portion provided with a flange portion Cf along the circumference, and in turn adheres the container lid Cl to the flange portion Cf to seal the container C. The container packaging apparatus 10 includes a container supply device 12 for supplying the container C, an ingredient-filling device 14 for feeding various ingredients into the container C while the container C is transported, and a sealing device 16 for sealing the opening of the container C with the container lid Cl, in this order from the upstream to downstream. The containers C sealed by the sealing device 16 are conveyed further downstream to a processing area via a discharge conveyor 18. Further, in the present embodiment, a defective product discharging conveyor 19 for discharging defective products is provided on the upstream side of the discharging conveyor 18.

The container supply device 12 includes a container stocker 12A for stocking a group G of containers C, in which a large number of containers C are stacked in multiple rows, and a transfer device 12B for transferring the containers C one by one from each row of the container stocker 12A to a retainer 14B of the conveyor 14A of the ingredient-filling device 14. In the illustrated example, each retainer 14B of the conveyor 14A holds four containers C side by side and conveys the containers C toward the sealing device 16.

In the ingredient-filling apparatus 14, a plurality of ingredient-supplying apparatuses for feeding each ingredient into the container C held by the retainer 14B are arranged above the conveyor 14A. In FIG. 1, four types of ingredients are supplied to each container C, which are intermittently conveyed by the conveyor 14A, by first to fourth ingredient-supplying devices 20A, 20B, 20C, and 20D. The ingredients may include, for example, solid blocks such as noodles or powdered soups, powders such as spices, seasonings or condiments, and liquids in addition to the powders. Further, on the upstream side of the first to fourth ingredient-supplying apparatuses 20A, 20B, 20C, and 20D of the ingredient-filling apparatus 14 of the present embodiment, there is provided a barcode reader and a container cleaner. The barcode reader is for reading a barcode on the container C for each retainer 14B to inspect whether or not a container from another lot has been included, and to detect any containers for which a barcode cannot be read. The container cleaner is for removing static electricity from the container C and cleaning the inside of the container using an air jet for each retainer 14B.

The sealing device 16 is disposed above the downstream side of the conveyor 14A. The sealing device 16 includes a flange portion cleaner 24, a lid supplier 26, a first sealer 28, a second sealer 30, a cooling system 32, a seal inspection system 34, a defective product discharger 36, and a container take-out system 38, from the upstream to the downstream.

As will be described later with reference to FIGS. 2 and 3, the flange portion cleaner 24 is a device for removing material deposited on the flange portion Cf. Representative of the deposited material are the contents filled in the container C by the first to fourth ingredient-supplying devices 20A, 20B, 20C, and 20D, which are caused by ingredients that are blown upward or splashed during filling of the ingredients. However, the deposited material on the flange portion Cf is not limited to the ingredients.

In the lid supplier 26, the container lid Cl is supplied from above in units for each retainer 14B. The container lid Cl is aligned with the flange unit Cf and mounted thereon. The first sealer 28 temporally bonds the peripheral edge portion of the container lid Cl partially to the flange portion Cf. The entire peripheral portion of the container lid Cl is then fully adhered to the flange portion Cf by the second seal portion 30 so that the container C is heat sealed. The cooling system 32 cools the flange portion Cf to which heat is applied. The seal inspection system 34 inspects the sealing status between the container C and the container lid Cl, such as positional deviation of the container lid Cl or leakage of the container C to determine if a seal failure has occurred.

The container C judged to have a sealing defect is taken out from the retainer 14B by the defective product discharger 36, transferred to the defective product discharging conveyor 19 positioned above the conveyor 14A, and discharged from the manufacturing line. On the other hand, the container C, which is determined not to have a sealing defect, is taken out from the retainer 14B by the container take-out system 38 on the downstream side and transferred to the discharge conveyor 18 to feed the container C to the downstream manufacturing line.

Next, the configuration of the flange portion cleaner 24 of the present embodiment will be described with reference to FIGS. 2 and 3. FIG. 2 is a front view of the flange portion cleaner 24 viewed from the conveying direction of the conveyor 14A.

The flange portion cleaner 24 is a device that uses an air jet for removing the ingredients or foreign matter deposited on the flange portion Cf. The flange portion cleaner 24 includes cleaning heads (a cleaner) 40 arranged corresponding to the opening of each container C held by the retainer 14B. The cleaning heads 40 are supported by a frame 41 and arranged along the longitudinal direction of the retainer 14B, i.e., in the lateral direction of the conveyor, above the conveyor 14A, whereby each of the cleaning heads 40 is positioned directly above the opening of each container C. In FIG. 2, four cleaning heads 40 are provided as an example. Incidentally, the frame 41 is supported by a base 46 of the conveyor 14A.

Figure 2:
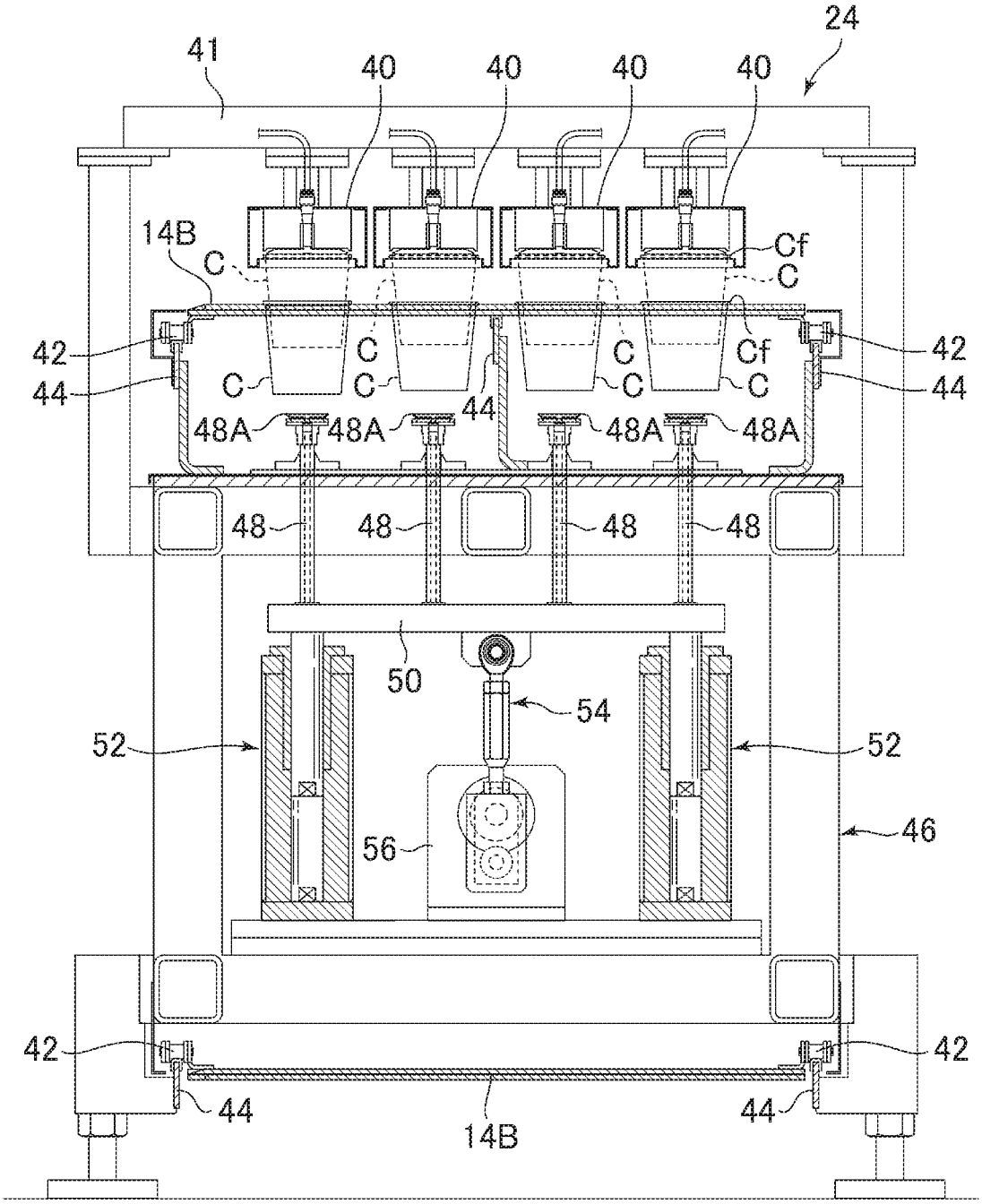
FIG. 2 is a front view of the flange cleaner viewed from the conveying direction of the conveyor.

As shown in FIG. 2, each retainer 14B is bridged over endless chains 42 disposed on both sides of the conveyor 14A. The endless chains 42 run on guides 44 disposed along both sides of the conveyor 14A so that the endless chains 42 are supported by the guides 44, respectively. In the present embodiment, the central portion of the upper retainer 14B is also supported by a guide 44. The guides 44 are fixed to and held by a base 46 of the conveyer 14A.

The retainer 14B is provided with holes into which each container C is inserted, and each container C fitted into each hole is held by engaging the flange portion Cf with the inner peripheral edge of the hole. Immediately below each cleaning head 40, a lifting rod 48 for lifting and lowering each container C is respectively disposed in an upright state. The lifting rod 48 is held by a support member 50, and the support member 50 is supported by a pair of cylinder mechanisms 52 whereby the support member 50 can be lifted and lowered with respect to the base 46. A motor 56 is connected to the support member 50 via a crank mechanism 54, for example, and the support member 50 and the lifting rod 48 are integrally lifted and lowered by the rotation of the motor 56 (a lifting device).

When the lifting rod 48 is being lowered, the upper end 48A of the lifting rod 48 is in a retracted position, which is below the bottom surface of the container C held by the retainer 14B. When the lifting rod 48 is raised, the upper end 48A of the lifting rod 48 abuts the bottom surface of the container C and pushes the container C upward from the retainer 14B. The lifting rod 48 lifts the container C to a cleaning position where its opening is adjacent the cleaning head 40. In FIG. 2, the container C supported by the retainer 14B is shown by a solid line, and the container C in the cleaning position is shown by a broken line.

Figure 3:
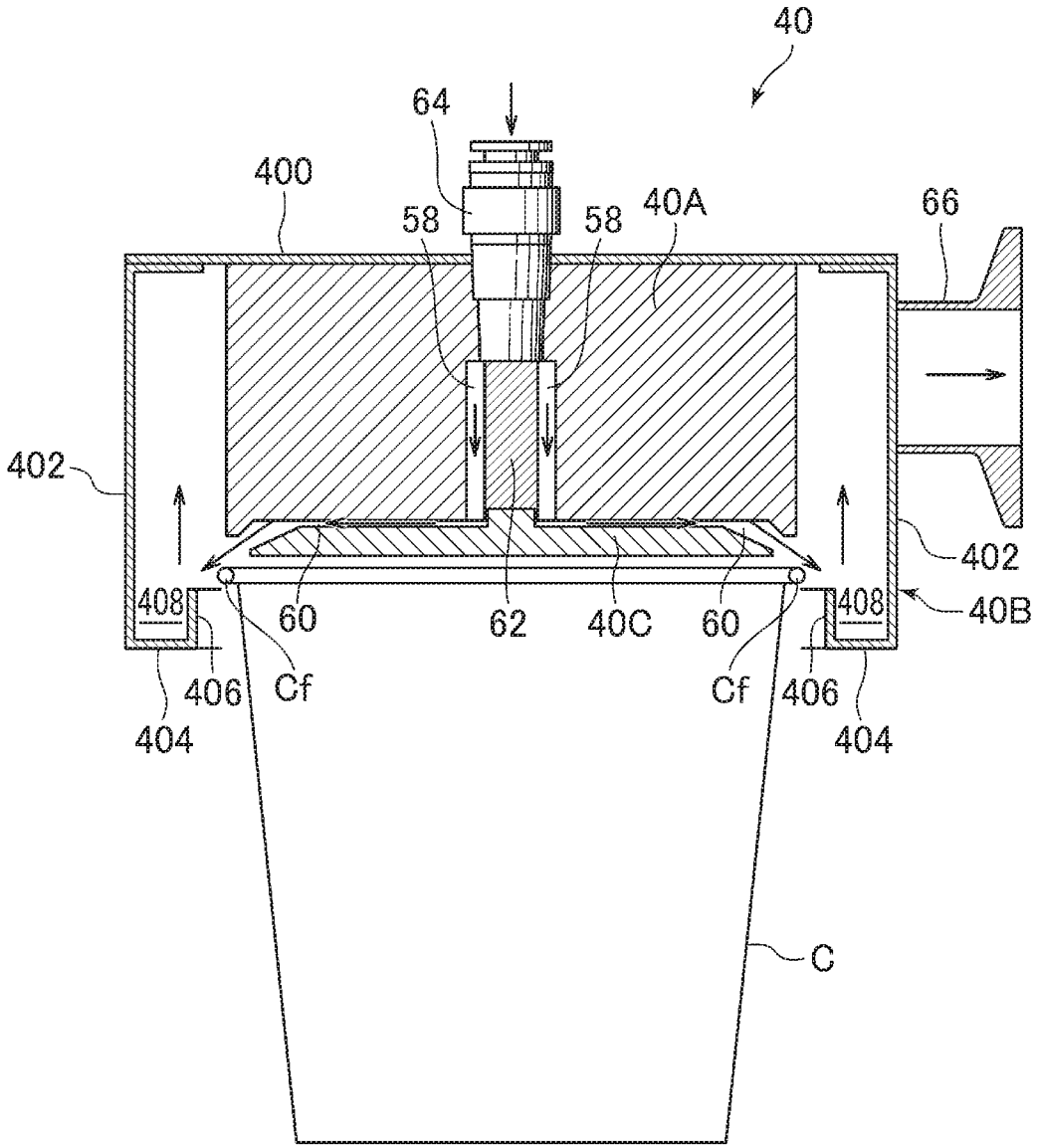
FIG. 3 is an enlarged sectional view of the cleaning head.

FIG. 3 is an enlarged cross-sectional view of the container C, which is in the cleaning position, and the cleaning head 40 corresponding thereto. The cleaning head 40 includes a main body 40A, a hood (a covering member) 40B surrounding the circumference of the main body 40A, and a guide plate (a guide member) 40C for guiding air supplied to the main body 40A.

The main body 40A is a block member having a circumference profile that follows the flange portion Cf of the container C. At the center of the main body 40A, an air passage 58 extending in a vertical direction for passing air from a pneumatic source (not shown) may be provided. The guide plate 40C is a plate member that is disposed along the lower surface of the main body 40A with a gap 60. In a plan view, the outer peripheral dimensions of the guide plate 40C is slightly smaller than the outer peripheral dimensions of the main body 40A.

Air is supplied from the air passage 58 to a gap 60 defined between the main body 40A and the guide plate 40C, and air flows radially toward the outer circumferential direction. The outer peripheral dimensions of the guide plate 40C are slightly smaller than the inner peripheral dimensions of the opening of the container C, and the upper surface of the outer peripheral portion of the guide plate 40C is tapered downward. In addition, the outer peripheral portion of the bottom surface of the main body 40A is inclined downward in accordance with the tapered shape of the outer peripheral portion of the guide plate 40C. That is, the outer periphery of the gap 60 is inclined downward toward the outside at a predetermined angle.

In the cleaning position, the lower surface of the guide plate 40C is disposed at a position slightly higher than the opening of the container C, and the outer peripheral edge of the guide plate 40C is disposed slightly inside of the inner peripheral edge of the flange portion Cf. Thereby, the air blown radially outward from the outer peripheral portion of the flange portion Df through the gap 60 is blown to the flange portion Cf of the container C, which is disposed in the cleaning position, from the obliquely upper side toward the outside.

The guide plate 40C is supported by a support rod 62 inserted into a hole provided in the central portion of the main body 40A along the vertical direction. The air passage 58 is defined between the inner circumference surface of the hole and the outer circumference surface of the support rod 62. An inlet 64 having an upper end connected to a pneumatic pressure source (not shown) through a pipe and a lower end connected to the air passage 58 is mounted at the center of the main body 40A.

A top surface 400 of the hood 40B covers the top surface of the main body 40A (excluding the portion where the inlet 64 is mounted), and a side surface 402 of the hood 40B extends downward from the outer periphery of the top surface 400 to a height entirely covering the outer circumference surface of the main body 40A and the outer circumference of the guide plate 40C, and further covers the outer periphery of the flange portion Cf of the container C placed in the cleaning position.

A bottom surface 404 of the hood 40B extends inwardly from the lower end of the side surface 402. The bottom surface 404 extends to a position slightly outside the outer peripheral edge of the flange portion Cf, and is folded upward at a right angle therefrom. The folded portion 406 folded upward from the inner peripheral edge of the bottom surface 404 extends to a height slightly lower than the flange portion Cf of the container C disposed in the cleaning position, and its upper end forms an opening for accommodating the container C, which is lifted to the cleaning position by the lifting rod 48. A recess portion 408 is defined by a space surrounded by the side surface 402, the bottom surface 404, and the folded portion 406. The recess portion 408 is disposed slightly below the flange portion Cf, in an area surrounding the periphery of the flange portion Cf when the container C is in the cleaning position.

An outlet 66 is attached to the side surface 402 of the hood 40B. The outlet 66 communicates with the inside of the hood 40B so that air in the hood 40B is sucked out through the outlet 66 and discharged through a pipe (not shown).

As shown in FIG. 3, the air supplied via the air passage 58 flows through the gap 60 of the cleaning head 40 and in turn is ejected from the outer periphery of the gap 60 so that the air is blown obliquely downward and radially outward over the entire periphery of the flange portion Cf of the container C disposed in the cleaning position. The recess portion 408 formed by the hood 40B is disposed ahead of the air ejected from the gap 60 so that foreign matter and the contents filled in container C, which are deposited on the flange portion Cf, are blown away toward the recess portion 408. The air ejected from the gap 60 is discharged through a space defined between the hood 40B and the main body 40A and the outlet 66. Meanwhile, the contents from inside the container C that were blown upward by the ejected air are blocked since the opening portion of the container C is substantially closed by the guide plate 40C. The air supply through the inlet 64 and the air suction from the outlet 66 are performed only while the container C is disposed in the cleaning position, in other words, only while the outer periphery of the flange portion Cf is covered with the hood 40B.

As described above, according to the present embodiment, it is possible to remove the foreign matter, the filled content, and the like deposited or adhered to the flange portion of the container without contaminating the inside of the container with the deposits or scattering the deposits to the periphery. Thereby, the occurrence of a seal defect is suppressed, sanitation is improved, and furthermore, the cleaning efficiency of the retainer is improved.

Although the planar shape of the container shown in the present embodiment is circular, the shape of the container may be other than a circular shape such as a rectangle, and in this case, a cleaning head having a shape adapted to the shape of the container is used. In the present embodiment, the conveyor intermittently conveys the containers, but if a mechanism for the cleaning head to follow the moving container is provided, it is also applicable to a configuration in which the containers are conveyed continuously. In the present embodiment, the container is raised and lowered toward the cleaning head. However, the cleaning head may be raised and lowered toward the container held by the retainer so that not only the flange portion but also the retainer can be cleaned at the same time.

Although the embodiment of the present invention has been described herein with reference to the accompanying drawings, obviously many modifications and changes may be made by those skilled in this art without departing from the scope of the invention.

The present disclosure relates to subject matter contained in Japanese Patent Application No. 2018-247151 (filed on Dec. 28, 2018), which is expressly incorporated herein, by reference, in its entirety.

The invention claimed is:

1. A container packaging apparatus, comprising:

a retainer for retaining a container;

a container supplier for supplying the container to the retainer;

a filler for filling contents into the container; and a cleaner for removing deposits on a flange portion of the container filled with the contents from the filler;

the cleaner comprising:

a hood for covering an outer periphery of the flange portion of the container to receive and accommodate the flange portion of the container therein;

a lifting device for relatively moving the hood up and down with respect to the container, wherein the lifting device moves the container relative to the hood such that the container is moved from outside of the hood to a position inside the hood wherein the hood receives the flange portion and covers an outer periphery of the flange portion of the container;

an ejector for ejecting gas over the entire area of the flange portion of the container when received inside the hood, wherein the ejector comprises a body and a guide member defining a gap therebetween for guiding the gas in a downward and radially outward direction relative to the container to blow off deposited matter on the flange portion of the container to an area outside of the container and within the hood; and a suction device provided inside the hood for removing the deposited matter that is blown off by the ejector into the area outside of the container and within the hood.

2. The container packaging apparatus according to claim 1, wherein the guide member blocks an opening of the container to prevent the contents from being blown upward.

3. The container packaging apparatus according to claim 2, wherein the lifting device holds a bottom portion of the container, the flange portion of which is supported by the retainer, and raises the container until the outer periphery of the flange portion of the container is received inside the hood.

4. The container packaging apparatus according to claim 1, wherein the lifting device holds a bottom portion of the container, the flange portion of which is supported by the retainer, and raises the container until the outer periphery of the flange portion of the container is received inside the hood.

5. The container packaging apparatus according to claim 1, wherein the hood includes:

a top surface, a side surface extending downward from the top surface, a bottom surface extending inward from a lower end of the side surface, a folded portion extending upward from an inner peripheral edge of the bottom surface, and a recess portion that is defined by a space surrounded by the side surface, the bottom surface and the folded portion, wherein the recess portion is positioned below the flange portion of the container when received inside the hood, and is positioned so that the deposited matter that is blown off from the flange portion of the container is blown toward the recess portion.

6. The container packaging apparatus according to claim 5, wherein the suction device includes an outlet that is attached to the side surface of the hood and above the recess portion and the flange portion of the container when received inside the hood.

* * * * *